US008228659B2

(12) United States Patent
Sakurai

(10) Patent No.: US 8,228,659 B2
(45) **Date of Patent: *Jul. 24, 2012**

(54) GLOW PLUG ELECTRIFICATION CONTROL APPARATUS AND GLOW PLUG ELECTRIFICATION CONTROL SYSTEM

(75) Inventor: Takayuki Sakurai, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 305 days.

This patent is subject to a terminal disclaimer.

(21) Appl. No.: 12/474,999

(22) Filed: May 29, 2009

(65) Prior Publication Data

US 2009/0296306 A1 Dec. 3, 2009

(30) Foreign Application Priority Data

May 30, 2008 (JP) ..... 2008-142451

(51) Int. Cl.
*F23Q 7/00* (2006.01)

(52) U.S. Cl. ..... 361/266; 361/264; 361/265

(58) Field of Classification Search ..... 361/264–266
See application file for complete search history.

(56) References Cited

U.S. PATENT DOCUMENTS

| | | | | |
|---|---|---|---|---|
| 5,724,932 | A * | 3/1998 | Antone | 123/145 A |
| 6,164,258 | A * | 12/2000 | Petrovich et al. | 123/179.6 |
| 2004/0255889 | A1 | 12/2004 | Kumada et al. | |

FOREIGN PATENT DOCUMENTS

| | | | |
|---|---|---|---|
| JP | 56-129763 | A | 10/1981 |
| JP | 60-67775 | A | 4/1985 |
| JP | 5113166 | A | 5/1993 |
| JP | 2004-44580 | A | 2/2004 |
| JP | 2004-232907 | A | 8/2004 |

* cited by examiner

*Primary Examiner* — Stephen W Jackson
*Assistant Examiner* — Terrence Willoughby
(74) *Attorney, Agent, or Firm* — Sughrue Mion, PLLC

(57) ABSTRACT

An electrification control apparatus (101) for glow plugs GP1 to GPn includes temperature-raising-period electrification control units S3 to S7, S31, S32 for raising the temperature of a heater section (2) of each glow plug. The control units perform electrification control in such manner that, even when a first glow plug GP1 and a second glow plug GP1*e*, which are of the same industrial part number but differ in resistance due to a characteristic variation therebetween, are selectively connected to the electrification control apparatus (101) and electrification control is performed therefor, at sampled timings t during the temperature rise, electric power of the same magnitude P(t) as that of electric power supplied to the first glow plug GP1 is supplied to the second glow plug GP1*e*.

8 Claims, 8 Drawing Sheets

GLOW PLUG ELECTRIFICATION CONTROL APPARATUS AND GLOW PLUG ELECTRIFICATION CONTROL SYSTEM

BACKGROUND OF THE INVENTION

1. Field of the Invention

The present invention relates to a glow plug electrification control apparatus for controlling the supply of electric current to a glow plug that assists startup of an internal combustion engine, and to a glow plug electrification control system using the same.

2. Description of the Related Art

In general, a glow plug has a resistance heater (heater section) which generates heat upon supply of electric current thereto. The glow plug is configured such that a resistance heater is attached to a metallic shell, and in use is attached to the engine block of a diesel engine such that the distal end of the resistance heater is located within a combustion chamber.

A glow plug electrification control apparatus has been known as an apparatus for controlling the supply of electric current to such a glow plug. Since such a glow plug has a relatively high resistance, a conventional glow plug electrification control apparatus is configured as follows. When a key switch is turned to an ON position, a switch (switching element) between a battery and a glow plug is maintained ON so as to supply a large current to the glow plug and raise the temperature of the resistance heater to a first target temperature (e.g., 1300° C.) which is sufficiently high for starting the engine. Such a step is generally called a "pre glow" or a "pre glow step." A glow plug capable of quick heating can raise the temperature of its resistance heater to the first target temperature within a few seconds (see Patent Documents 1 and 2).

In recent years, a glow plug of a quick temperature raising type has emerged which can raise the temperature of its resistance heater to 1000° C. or higher within about 2 seconds, by further reducing the resistance of the heater section.

In a known control method performed during temperature rise of a glow plug, the amount of cumulative power supplied to the glow plug is controlled so as to raise the temperature of the glow plug to a sufficiently high temperature without being affected by the battery voltage and to prevent excessive temperature rise. Specifically, voltage applied during the temperature rise and current flowing through the glow plug during the temperature rise are measured; electric power supplied to the glow plug is calculated and integrated so as to calculate the cumulative amount of electric power; and the temperature of the glow plug is raised until the cumulative amount of electric power reaches a predetermined value (see Patent Document 3).

[Patent Document 1] Japanese Patent Application Laid-Open (kokai) No. S56-129763

[Patent Document 2] Japanese Patent Application Laid-Open (kokai) No. S60-67775

[Patent Document 3] Japanese Patent Application Laid-Open (kokai) No. 2004-232907

3. Problem to be Solved by the Invention

However, even glow plugs of the same part number, which are industrially handled as the same part and are regarded as having the same performance, show variation in their respective resistances. Accordingly, when a battery voltage is applied via a switching element to a glow plug having a relatively low resistance, a relatively large current flows therethrough. As a result, the speed of temperature rise is high, the glow plug reaches a high temperature within a short period of time, and the cumulative amount of electric power supplied to the glow plug reaches a predetermined value within a short period of time. In addition, since the temperature of the glow plug is raised within a short period of time, the amount of heat which escapes from the glow plug to an engine head or the like during the temperature rise decreases. Thus, the glow plug having a lower resistance reaches a higher temperature, as compared with a glow plug having a higher resistance, even when the same cumulative amount of electric power is supplied thereto.

Meanwhile, when the battery voltage is applied via the switching element to a glow plug having a relatively high resistance, a relatively small current flows therethrough. As a result, the speed of temperature rise is low, the glow plug requires a long period of time to reach a high temperature, and a long period of time is required for the cumulative amount of electric power supplied to the glow plug to reach the predetermined value. In addition, since the glow plug requires a long period of time to reach a high temperature, a larger amount of heat escapes from the glow plug to the engine head or the like during the temperature rise. Thus, the glow plug having a higher resistance can reach only a lower temperature, as compared with a glow plug having a lower resistance, even when the same cumulative amount of electric power is supplied.

That is, due to variation in resistance among glow plugs, variations arise not only with regard to the temperature rising time, but also the ultimate temperature that the respective glow plugs can reach. Thus, various problems arise, such as variation in engine ignitability.

SUMMARY OF THE INVENTION

The present invention has been accomplished in view of the above-described problems of the related art, and an object thereof is to provide a glow plug electrification control apparatus which can raise the temperature of individual glow plugs to follow the same temperature rising curve even when resistance varies among the glow plugs in use, and a glow plug electrification control system using the same.

The above object of the present invention has been achieved by providing (1) a glow plug electrification control apparatus which supplies electric current to a heater section of a glow plug to thereby generate heat and raise the temperature of the heater section, the electrification control apparatus comprising temperature-raising-period electrification control means for raising the temperature of the heater section of the glow plug in such manner that, even when a first glow plug and a second glow plug, which differ in resistance, are selectively connected to the electrification control apparatus and electrification control is performed therefor, at sampled timings during the temperature rise, electric power of the same magnitude as that of electric power supplied to the first glow plug is supplied to the second glow plug.

In a preferred embodiment (2) of the glow plug electrification control apparatus according to (1) above, the temperature of the heater section of each of the first glow plug and the second glow plug is raised under the same ambient temperature conditions.

The glow plug electrification control apparatus of the present invention performs electrification control in such a manner that, even when a first glow plug and a second glow plug, which are of the same part number but differ in resistance, are selectively connected so as to raise the temperature of the first glow plug or the second glow plug, electric power of the same magnitude as that of electric power supplied to the first glow plug is supplied to the second glow plug at each point in time (or rather at sampled timings) during the temperature rise which is to be understood as including continuous monitoring and control. That is, even when the first glow plug and the second glow plug differ in resistance due to a characteristic variation therebetween, the first glow plug and the second glow plug can receive electric power of the same magnitude at the same point in time. Therefore, the heater sections of the first glow plug and the second glow plug can generate the same amount of heat. Accordingly, the temperatures of the first glow plug and the second glow plug, which differ in resistance, can be raised to the same temperature to follow the same temperature rising curve over the same temperature rising time.

Notably, no limitation is imposed on a pattern according to which electric power is supplied to the first glow plug and the second glow plug so as to raise their temperatures, so long as electric power of the same magnitude is supplied to the first glow plug and the second glow plug at each point in time. Accordingly, examples of the electric power supply pattern include a pattern in which constant electric power is continuously supplied and a pattern in which the magnitude of electric power to be supplied is decreased gradually (specifically, the magnitude of electric power to be supplied is decreased continuously or the magnitude of electric power to be supplied is decreased stepwise).

Further, the first glow plug and the second glow plug to be compared can be placed under the same ambient temperature condition by means of, for example, attaching the first glow plug and the second glow plug to the same engine or engines of the same model, and maintaining the same ambient temperate and the same engine cooling water temperature.

Examples of a method of controlling electric power supplied to a glow plug include a method in which a battery voltage is applied to a glow plug (first or second glow plug) via a switching element, and the electric power applied to the glow plug (first glow plug, etc.) is controlled by means of PWM (Pulse Width Modulation) control which turns the switching element on and off; and a method in which electric power supplied to a glow plug is controlled by means of limiting the current flowing through the glow plug.

Further, examples of a glow plug to which the present invention is applied include a so-called metal glow plug whose heater section is formed of a metal wire which generates heat through supply of electric current to the metal wire, and a so-called ceramic glow plug whose heater section is formed of an electrically conductive ceramic which generates heat through supply of electric current to the ceramic.

In another preferred embodiment (3) of the glow plug electrification control apparatus according to (1) above, the temperature-raising-period electrification control means includes supply power magnitude control means for supplying the glow plug with electric power of a magnitude which is previously determined in accordance with time which has elapsed from the start of supply of electric current to the heater section.

In the glow plug electrification control apparatus of the present invention, the glow plug is supplied with electric power whose magnitude is previously determined in accordance with time which has elapsed from the start of electrification. Accordingly, even when the first glow plug and the second glow plug which differ in resistance are selectively connected to the electrification control apparatus, the first glow plug and the second glow plug can receive electric power of the same magnitude at each point in time and generate heat of the same amount. Therefore, the temperatures of the heater sections of the first glow plug and the second glow plug, which differ in resistance, can be raised to generally follow the predetermined same temperature rising curve.

Notably, preferably, electric power whose magnitude is previously determined in accordance with time which has elapsed from the start of electrification is supplied to the glow plug in accordance with a pattern determined such that a large amount of electric power is supplied in an initial stage after the start of electrification (in a low temperature region) so as to increase the temperature of the heater section to a high-temperature region within a short period of time. Further, when a certain period of time has elapsed and the temperature of the heater section has reached a high temperature, a relatively small amount of electric power is supplied so as to prevent the temperature of the heater section from becoming excessively high. An example of such an electric power supply pattern is a pattern in which electric power to be supplied is decreased gradually (decreased continuously or stepwise).

In yet another preferred embodiment (4) of the glow plug electrification control apparatus according to (3) above, the supply power control means includes reference power magnitude provision means for providing a reference power magnitude Pb(t) to be supplied to the glow plug at an elapsed time t, as counted from the start of supply of electric current to the heater section; and power magnitude control means for performing electrification control such that the magnitude of electric power supplied to the glow plug at the elapsed time t coincides with the reference power magnitude Pb(t).

In the glow plug electrification control apparatus of the present invention, the reference power magnitude provision means provides a reference power magnitude Pb(t) to be used at the elapsed time t, and the power magnitude control means performs electrification control such that the magnitude of electric power supplied to the glow plug coincides with the reference power magnitude Pb(t). By virtue of such control, even when the first plug and the second plug, which differ in resistance, are selectively connected to the electrification control apparatus, at each point in time, the magnitude of electric power to be supplied to the first glow plug and the magnitude of electric power to be supplied to the second glow plug can readily be made equal to the reference power magnitude Pb(t).

Notably, the reference power magnitude Pb(t) may be a value determined from the elapsed time t only. Alternatively, the reference power magnitude Pb(t) may be a value reflecting the ambient temperature, the water temperature of an engine, and time elapsed from a previous operation; e.g., a value which is properly corrected in consideration of these conditions.

Further, in yet another preferred embodiment (5) of the glow plug electrification control apparatus according to (4) above, the power magnitude control means includes parameter (voltage-etc.) acquisition means for acquiring, at each elapsed time t, a voltage Vg(t) applied to the glow plug and at least one of a current Ig(t) flowing through the glow plug and a resistance Rg(t) of the glow plug; duty ratio acquisition means for acquiring a duty ratio D(t) by use of the reference power magnitude Pb(t), the applied voltage Vg(t), and at least one of the current Ig(t) and the resistance Rg(t); and pulse electrification means for supplying the glow plug with electricity in the form of pulses and at the duty ratio D(t).

In the glow plug electrification control apparatus of the present invention, the parameter acquisition means acquires at least one of the current Ig(t) and the resistance Rg(t), as well as the applied voltage Vg(t), for the glow plug, and the duty ratio acquisition means acquires the duty ratio D(t) from these data and the reference power magnitude Pb(t). Further, the pulse electrification means supplies the glow plug with electric current in the form of pulses and at the duty ratio D(t).

By virtue of such control, even when the first plug and the second plug, which differ in resistance, are selectively connected to the electrification control apparatus, the magnitude of electric power to be supplied to the first glow plug and the second glow plug at each elapsed time t can readily be made equal to the reference power magnitude Pb(t) through PWM control.

Notably, the duty ratio acquisition means may employ a method of calculating the duty ratio D(t) from the reference power magnitude Pb(t) and at least one of the current Ig(t) and the applied voltage Vg(t), and calculating the duty ratio D(t) such that the magnitude of electric power supplied to the glow plug becomes equal to the reference power magnitude Pb(t). Specifically, preferably, the duty ratio D(t) is determined in accordance with the following expression.

$$D(t)=Pb(t)\cdot Rg(t)/Vg(t)^2=Pb(t)/(Vg(t)\cdot Ig(t)).$$

In yet another preferred embodiment (6) of the glow plug electrification control apparatus according to (3) above, the supply power control means includes parameter acquisition means for acquiring, at each elapsed time t, a voltage Vg(t) applied to the glow plug, and at least one of a current Ig(t) flowing through the glow plug and a resistance Rg(t) of the glow plug; duty ratio acquisition means for acquiring a duty ratio D(t) from the resistance Rg(t) and the applied voltage Vg(t); and pulse electrification means for supplying the glow plug with electric current in the form of pulses and at the duty ratio D(t).

In the glow plug electrification control apparatus (2) of the present invention, the parameter acquisition means acquires at least one of the current Ig(t) and the resistance Rg(t), as well as the applied voltage Vg(t), and the duty ratio acquisition means acquires the duty ratio D(t) from these data. Further, the pulse electrification means supplies the glow plug with electricity in the form of pulses and at a duty ratio D(t).

By virtue of such control, even when the first plug and the second plug, which differ in resistance, are selectively connected to the electrification control apparatus, the magnitude of electric power to be supplied to the first glow plug and the second glow plug at each elapsed time t can be readily controlled through PWM control.

Notably, other exemplary methods which the duty ratio acquisition means may employ include a method of calculating the duty ratio D(t) from the applied voltage Vg(t) and at least one of the current Ig(t) and the resistance Rg(t), and a method of acquiring the duty ratio D(t) by reference to a correspondence table in which, for each elapsed time t, a duty ratio D(t) is related to the applied voltage Vg(t) and at least one of the current Ig(t) and the resistance Rg(t).

In another aspect (7), the present invention provides a glow plug electrification control system which comprises the glow plug electrification control apparatus according to any of (1) to (6) above and the glow plug.

The glow plug electrification control system incorporates the above-described glow plug electrification control apparatus. Therefore, even when a glow plug to be used differs in resistance from other glow plugs due to a characteristic variation (as in the case of the above-described first glow plug and second glow plug), irrespective of the difference in characteristic, the temperature of the glow plug can be raised to the same temperature and can follow the same temperature rising curve over the same temperature rising time.

BRIEF DESCRIPTION OF THE DRAWINGS

Illustrative aspects of the invention will next be described in detail with reference to the following figures wherein.

DESCRIPTION OF REFERENCE NUMERALS

Figure 1:
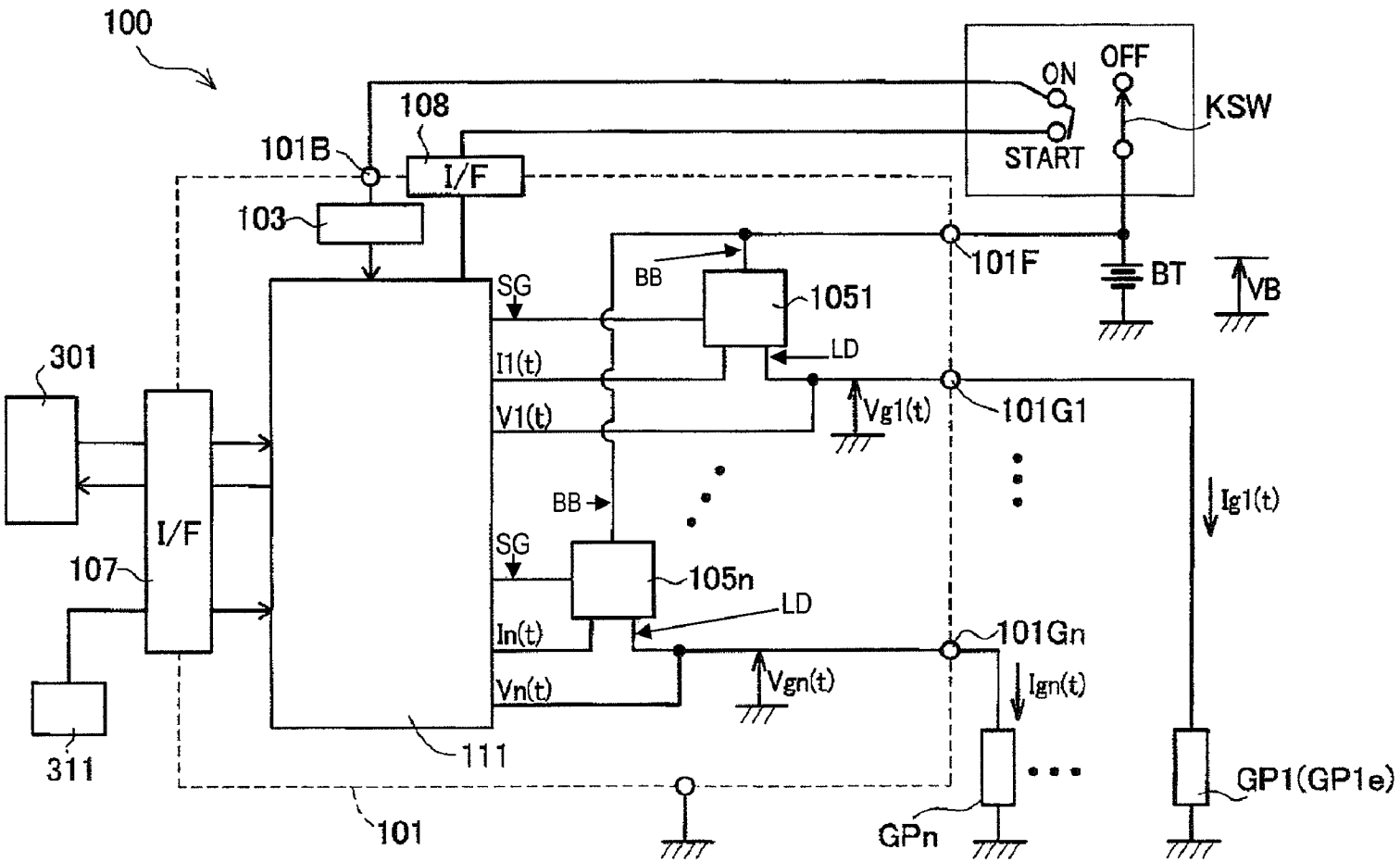
FIG. 1 is a circuit diagram showing a glow plug electrification control system and a glow plug electrification control apparatus according to Embodiment 1.

Reference numerals used to identify various structural features in the drawings include the following.

1: glow plug
2: sheathed heater (heater section)
100, 200: glow plug electrification control system
101, 201: glow plug electrification control apparatus
1051 to 105*n*, 2051 to 205*n*: switching elements
2061 to 206*n*: FETs
2071 to 207*n*: reference resistors
2081 to 208*n*: resistance division circuits
V1(*t*) to Vn(t): voltage signals (from glow plugs)
I1(*t*) to In(t): current signals (from switching elements)
111, 211: main control section
GP, GP1 to GPn: glow plugs
GP1: glow plug (first glow plug)
GP1*e*: glow plug (second glow plug) (after replacement)
Vg1(*t*) to Vgn(t): applied voltages (voltage applied to glow plugs)
Ig1(*t*) to Ign(t): currents (currents flowing through glow plugs)
Rg1(*t*) to Rgn(t): resistances of (glow plugs)
P(t): electric power magnitude
Pb(t): reference power magnitude
D1(*t*) to Dn(t): duty ratios
S3 to S7, S31, S32 to S7, S61: temperature-raising-period electrification control means, supply power control means
S3 to S5, S31, S32 to S5: reference power magnitude provision means
S6, S7: power magnitude control means
S3, S4, S31, S32: voltage-etc. acquisition means
S6, S61: duty ratio acquisition means
S7: pulse electrification means

DESCRIPTION OF THE PREFERRED EMBODIMENTS

Certain embodiments of the present invention will now be described in greater detail with reference to the drawings. However, the present invention should not be construed as being limited thereto.

Embodiment I

Figure 2:
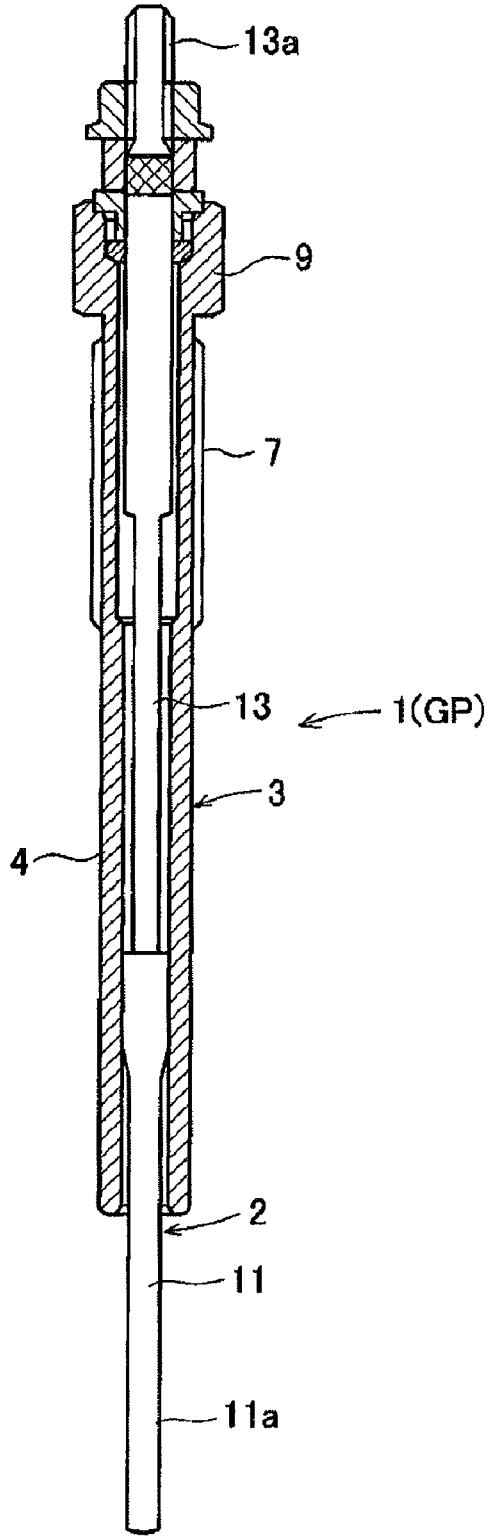
FIG. 2 is a sectional view of a glow plug used in Embodiments 1 and 2.
Figure 3:
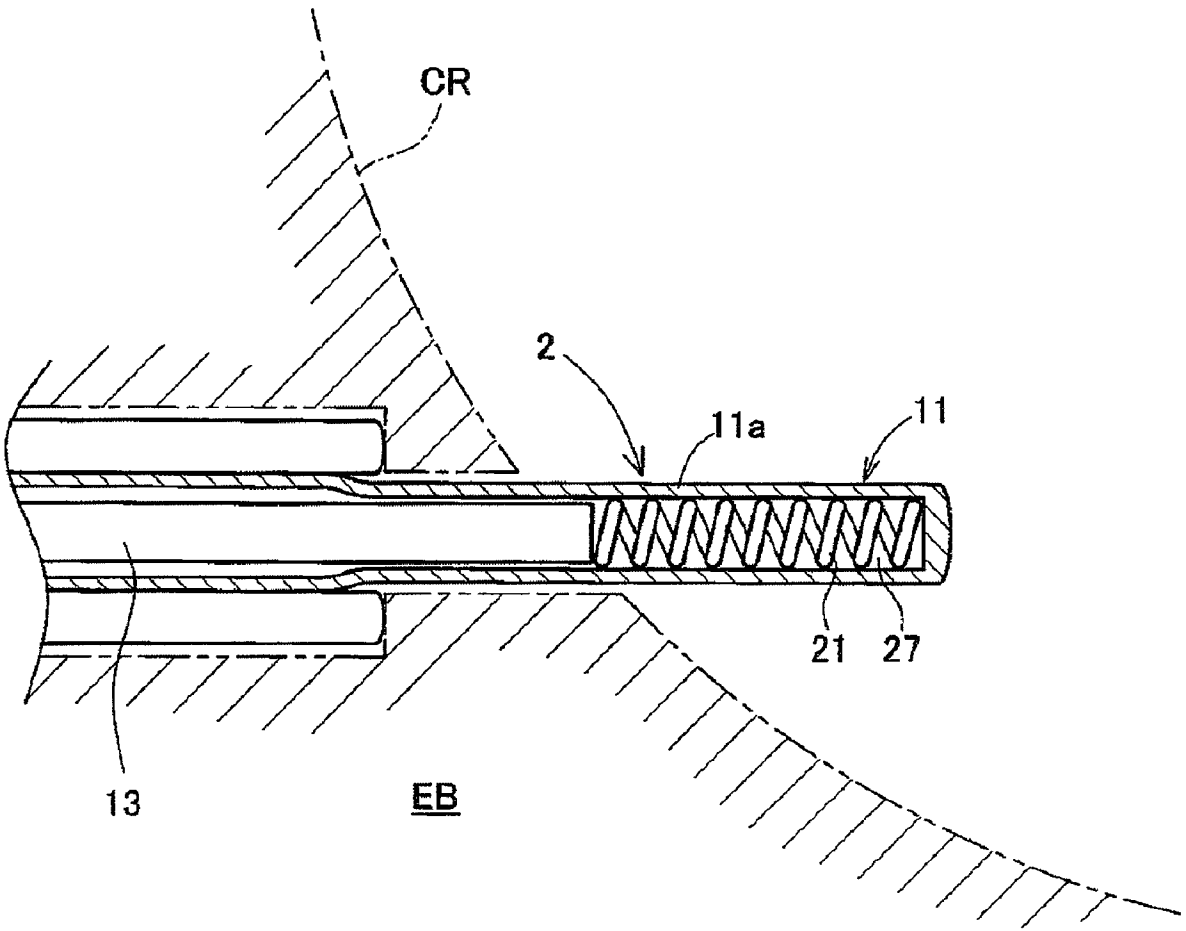
FIG. 3 is a partial sectional view relating to Embodiments 1 and 2 and shows a state in which the glow plug is attached to an engine.

First, a glow plug 1 subject to electrification control by a glow plug electrification control apparatus 101 of the present invention will be described. FIG. 2 shows a cross sectional view of the glow plug 1. FIG. 3 shows a state in which the glow plug 1 is mounted to an engine block EB of a diesel engine.

The glow plug 1 includes a sheathed heater 2 configured as a resistance heater, and a metallic shell 3 disposed on the radially outer side of the sheathed heater 2. As shown in FIG. 3, the sheathed heater 2 includes a heating coil 21 formed of a resistance wire. The heat generation coil 21, together with magnesia powder (insulating material, containing MgO as a principal component) 27, is disposed, in a sealed condition, inside a sheath tube 11 having a closed tip end. As shown in FIG. 2, a distal end portion of a body portion 11*a* of the sheath tube 11 which accommodates the heat generation coil 21 projects from the metallic shell 3. As shown in FIG. 3, the heat generation coil 21 is electrically connected at its distal end with the sheath tube 11. However, the outer circumference of the heat generation coil 21 is isolated from the inner circumferential surface of the sheath tube 11 by means of the magnesia powder 27 present therebetween.

The heat generation coil 21 is formed of, for example, an Fe—Cr alloy or a Ni—Cr alloy.

Further, a bar-shaped electricity supply terminal rod 13 is inserted into the sheath tube 11 from its proximal end side. The distal end of the electricity supply terminal rod 13 is connected to the proximal end of the heat generation coil 21 by means of welding. Meanwhile, as shown in FIG. 2, a rear end portion of the electricity supply terminal rod 13 is formed into an external thread portion 13*a* on which an external thread is formed. Further, the metallic shell 3 is formed into a tubular shape and has an through hole 4 extending in an axial direction. The sheathed heater 2 is inserted into the through hole 4 from its one open end thereof and fixed to the metallic shell 3 in such manner that a distal end portion of the sheath tube 11 projects a predetermined distance from the open end. A tool engagement portion 9 having a hexagonal cross section is formed on the outer circumferential surface of the metallic shell 3. When the glow plug 1 is attached to a diesel engine, a tool such as a torque wrench is engaged with the tool engagement portion 9. A thread portion 7 for attachment is formed on the distal end side of the tool engagement portion 9.

As shown in FIG. 3, the glow plug 1 is attached to a plug hole of the engine block EB of a diesel engine or the like by means of the thread portion 7 of the metallic shell 3. The distal end portion of the sheathed heater 2 projects into an engine combustion chamber CR over a predetermined length. The entire heat generation coil 21 is located within the engine combustion chamber CR.

Next, a glow plug electrification control system 100 and the glow plug electrification control apparatus 101 of the present embodiment will be described. FIG. 1 is a block diagram showing the electrical configurations of the glow plug electrification control system 100 and the glow plug electrification control apparatus 101 of the present embodiment. In addition to the glow plug electrification control apparatus 101, which will be described in detail below, the glow plug electrification control system 100 includes a plurality of (n) glow plugs 1 (GP1 to GPn) for which the glow plug electrification control apparatus 101 performs electrification control; a battery BT for supplying electric current to the glow plug GP1, etc.; and a key switch KSW for instructing supply of electric current to the glow plug GP1, etc., operation of the engine (not shown in FIG. 1), and startup (cranking) of the engine. Further, the glow plug electrification control system 100 is connected to an engine control unit (hereinafter also referred to as "ECU") 301 and an alternator 311 via an interface circuit 107.

A main control section 111 of the glow plug electrification control apparatus 101 receives via a power supply circuit 103 a stable operation voltage for signal processing. The power supply circuit 103 receives electric current from the battery BT via the key switch KSW and a terminal 101B. Accordingly, when the key switch KSW is turned to an ON position or a start position, electric current is supplied to the power supply circuit 103, so that the main control section 111 operates. Meanwhile, when the key switch KSW is turned to the OFF position, supply of electric current to the power supply circuit 103 is ended, and the main control section 111 stops the operation. Notably, when the key switch KSW is turned to the start position, a signal indicating that the key switch KSW has been turned to the start position is supplied to the main control section 111 via the interface circuit 108, whereby the main control section 111 can detect the engine cranking.

Further, electric current is supplied from the battery BT to n switching elements 1051 to 105*n* via a battery connection terminal 101F. In the present Embodiment 1, an FET having a current detection function (a product of Infineon Technologies AG; PROFET® part number BTS 6143 D) is used as the switching elements 1051 to 105*n*. The voltage VB of the battery BT is supplied to respective power supply terminals BB of the switching elements 1051 to 105*n*. Meanwhile, respective output terminals LD of the elements 1051 to 105*n* are connected to the plurality of (n) glow plugs GP1 to GPn via corresponding glow connection terminals 101G1 to 101Gn. Switching signals are supplied from the main control section 111 to respective input terminals SG of the elements 1051 to 105*n*. The elements 1051 to 105*n* turn ON and OFF in accordance with the voltage levels (high/low) of the switching signals so as to switch (ON/OFF) the supply of electric current to the glow plugs GP1 to GPn.

Further, current signals I1(*t*) to In(t) are supplied from the elements 1051 to 105*n* to the main control section 111. The current signals I1(*t*) to In(t) represent the respective magnitudes of currents Ig1(*t*) to Ign(t) flowing between the power supply terminals and the output terminals of the elements; i.e., flowing through the glow plugs GP1 to GPn, respectively.

Moreover, in addition to the current signals I1(*t*) to In(t), voltage signals V1(*t*) to Vn(t) are supplied to the main control section 111. The voltage signals V1(*t*) to Vn(t) represent voltages Vg1(*t*) to Vgn(t) applied to the glow plugs GP1 to GPn at those times when the switching elements 1051 to 105*n* are on. The current signals I1(*t*) to In(t) and the voltage signals V1(*t*) to Vn(t) supplied to the main control section 111 are converted to digital data by means of unillustrated A/D converters as needed, and are processed within the main control section 111.

The main control section 111 is configured to communicate with the engine control unit 301, which is composed of a microcomputer, via the interface circuit 107. Further, the main control section 111 is configured to receive a drive signal from the alternator 311 so as to determine whether or not the alternator 311 generates electricity; i.e., whether or not the engine operates.

Figure 4:
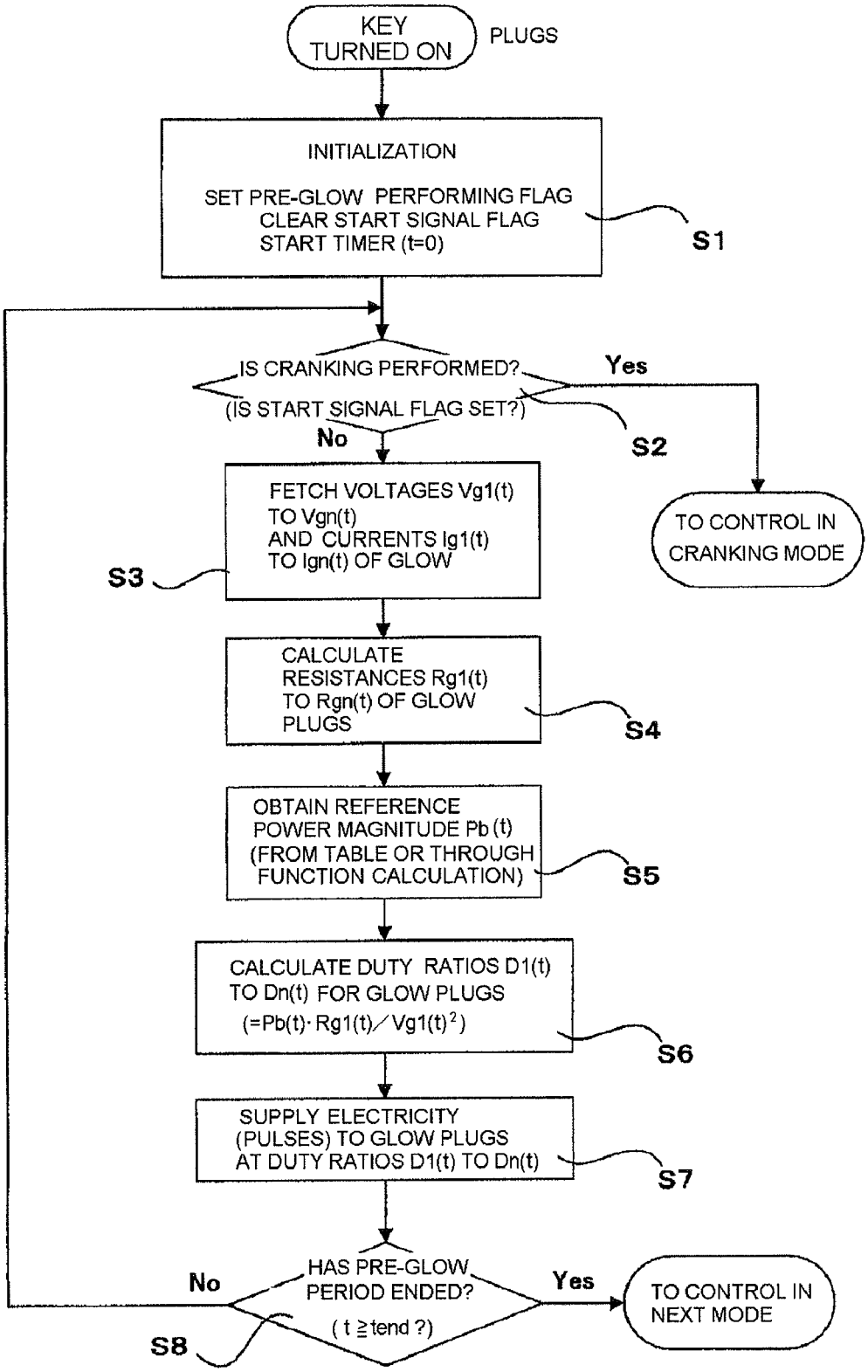
FIG. 4 is a flow chart showing electrification control performed by the glow plug electrification control apparatus according to Embodiment 1.

Next, electrification control performed for the glow plugs 1 (GP1 to GPn) by the glow plug electrification control system 100 and the glow plug electrification control apparatus 101 will be described with reference to a flowchart shown in FIG. 4.

In this electrification control, basically, the following operations are performed. First, when an operator turns the key switch KSW to the ON position, a pre-glow step, which is controlled by pre-glow means, is started. That is, electric power is supplied from the battery BT to the glow plugs 1 (GP1 to GPn), while the electric power supplied at each point in time is controlled. Thus, the temperature of the sheathed heater 2 is raised for a predetermined short period of time to a first target temperature (e.g., 1300° C.) within a high temperature range.

Subsequently, the control apparatus proceeds to the next mode (maintaining mode) so as to maintain the high temperature. Specifically, the control apparatus controls supply of electricity to the glow plugs 1 by means of PWM control on the basis of the voltages Vg1(*t*) to Vgn(t) applied to the glow plugs 1, to thereby maintain the high temperature of the sheathed heater 2.

Notably, when the operator turns the key switch KSW to the start position in order to start the engine, the control apparatus moves to a cranking mode. Since the sheathed heater 2 is cooled by means of, for example, swirls generated as a result of cranking, preferably, the control apparatus performs the control in a mode different from the maintaining mode. That is, the control apparatus PWM-controls the supply of electricity to the glow plugs 1 on the basis of the voltages Vg1(*t*) to Vgn(t) applied to the glow plugs 1 (GP1 to GPn), so as to suppress a drop in the temperature of the sheathed heater 2, to thereby improve startability of the engine.

Further, after the startup of the engine, the control apparatus proceeds to a post-startup glow mode so as to control the temperature of the sheathed heater 2 over a predetermined period of time (e.g., 180 seconds) to thereby maintains the temperature at a second target temperature (e.g., 900° C.).

Of these modes, the present invention relates the pre-glow mode for quickly raising the temperature of the sheathed heater 2. Therefore, control in this pre-glow mode will be described in detail, and detailed descriptions of other modes will be omitted.

First, when the operator turns the key switch KSW to the ON position, electric power is supplied to the main control section 111 (see FIG. 1). Specifically, a drive voltage is applied from the battery BT to the main control section 111 via the key switch KSW, the power supply connection terminal 101B, and the power supply circuit 103, whereby the main control section 111 starts to operate in a predetermined procedure.

First, in step S1, the main control section 111 initializes its program. Specifically, a pre-glow performing flag (a flag indicating that a pre-glow step is currently performed) is set. Meanwhile, a start signal flag (a flag indicating that the key switch KSW has been turned to the start position) is cleared. Further, a timer for counting the elapsed time t is started after the elapsed time t is set to 0.

Next, in step S2, the main control section 111 determines whether or not the engine is cranking; specifically, whether or not the start signal flag is set. When the start signal flag is not set (No), the main control section 111 proceeds to step S3. Meanwhile, when the start signal flag is set (Yes), the main control section 111 stops the operation in the pre-glow mode (the processing in step S3 and subsequent steps), and starts operation in the cranking mode.

The detailed description of operation in the cranking mode is omitted. Further, when the operator turns the key switch KSW to the start position, a signal is supplied to the main control section 111 via the interface circuit 108. In response to this signal, the start signal flag is set by means of unillustrated interruption processing.

In step S3, at a timing when the switching elements 1051 to 105*n* are on, the main control section 111 fetches, as voltage signals V1(*t*) to Vn(t), the voltages Vg1(*t*) to Vgn(t) applied to the glow plugs GP1 to GPn, and also fetches, as current signals I1(*t*) to In(t), currents Ig1(*t*) to Ign(t) flowing through the glow plugs GP1 to GPn. In step S4, the main control section 111 calculates the resistances Rg1(*t*) to Rgn(t) of the glow plugs GP1, etc., at the instant time (at the elapsed time t from the start of electrification) (Rg1(*t*)=Vg1(*t*)/Ig1(*t*), . . . , Rgn(t)=Vgn(t)/Ign(t)).

Next, in step S5, the main control section 111 obtains a reference power magnitude Pb(t) at the instant time (at the elapsed time t from the start of electrification). In the present embodiment, specifically, a table which correlates the relation between the elapsed time t and the reference power magnitude Pb(t) is previously prepared (stored in the main control section 111), and a reference power magnitude Pb(t) corresponding to the elapsed time t is obtained.

Notably, in the present embodiment, the relation between the elapsed time t and the reference power magnitude Pb(t) is obtained as follows. First, of the glow plugs 1 (GP1, etc.) whose resistances Rg fall within an allowable range (e.g., 180 to 220 mΩ), a glow plug (sample) having a relatively high resistance (e.g., 215 mΩ) close to the upper limit is selected and attached to a predetermined engine. Subsequently, a battery voltage VB is set to 8.0 V, which is the lower limit for driving the glow plug, and a switching element corresponding to the switching element 1051, etc. is continuously turned on. That is, the duty ratio is set to 100%. As a result, the temperature of the sample glow plug rises, and reaches a predetermined temperature (e.g., 1300° C.) at an elapsed time $t_{end}$.

However, the temperature rises at a slower speed (i.e., the time required to reach a predetermined temperature is longer) as compared with a case where the battery voltage VB is higher or a case where a glow plug 1 having a lower resistance Rg is used. In other words, the temperature rising speed is relatively slow when the battery voltage VB is small due to its variation or when the glow plug 1 having a lower resistance Rg is employed, similar to the case where the glow plug 1 is energized at a duty ratio set to be 100%, which also causes a slow temperature rising speed.

Further, as the temperature raises, the resistance of the sheathed heater 2 increases, so that the current flowing through the glow plug 1 decreases. Consequently, the magnitude of electric power supplied to the glow plug decreases as the elapsed time t increases. This change is shown in FIG. 5.

Figure 5:
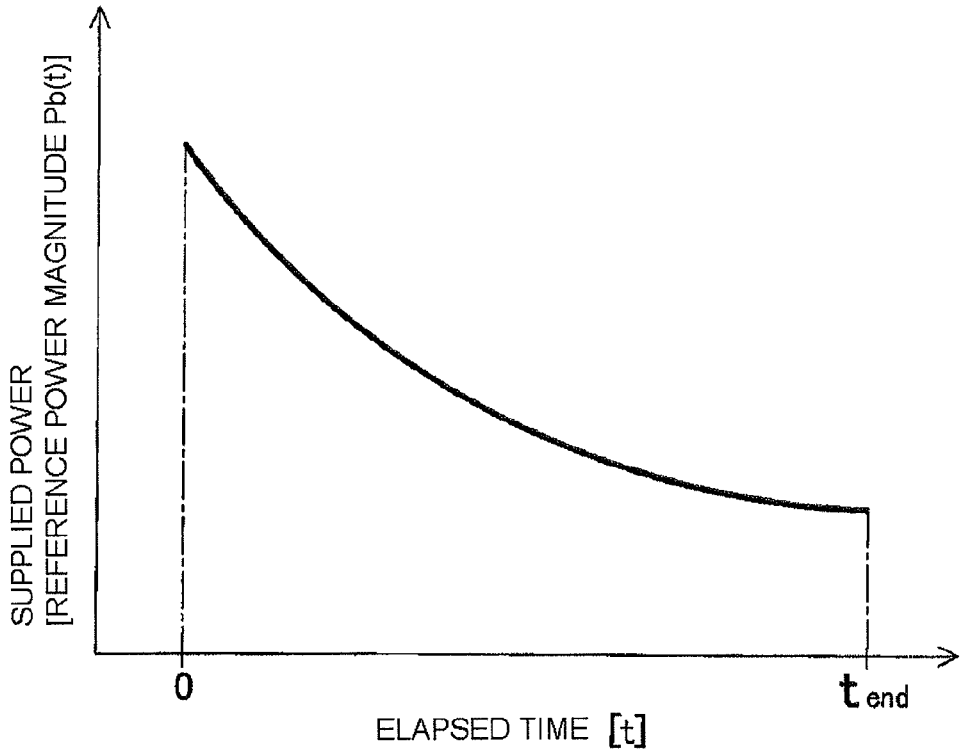
FIG. 5 is a graph schematically showing the relation between the elapsed time t and electric power supplied to the sample glow plug for the case where a voltage is continuously applied to the glow plug.

In the present embodiment, a curve shown in FIG. 5 is used as a curve which represents a change in the reference power magnitude Pb(t), and each time t and a value of the reference power magnitude Pb(t) at that time are stored in a table.

Thus, except for a case where the battery voltage VB is low (in the present embodiment, lower than 8.0 V (the above-described lower limit)) and the resistance of the glow plug GP is high (in the present embodiment, grater than 215 mΩ), at each elapsed time t, electric power whose magnitude P(t) is equal to the corresponding reference power magnitude Pb(t) can be supplied to the glow plugs GP1, etc., through PWM control at a duty ratio of less than 100%.

Notably, in the present embodiment, the reference power magnitude Pb(t) is obtained from the table stored in the main control section 111 by use of the elapsed time t. However, the curve shown in FIG. 5 may be stored as a function which provides the reference power magnitude Pb(t). In such a case, the reference power magnitude Pb(t) is calculated on the basis of the value of the elapsed time t when needed.

Further, the present embodiment exemplifies a case where when the elapsed time t is given, the reference power magnitude Pb(t) can be unequivocally obtained from the table. However, the reference power magnitude Pb(t) may be selected in consideration of other factors. For example, the embodiment may be modified in such a manner as to obtain other factors, such as ambient temperature, engine water temperature, and elapsed time from a previous operation, separately from the elapsed time t, and obtain the reference power magnitude Pb(t) from the elapsed time t and the engine water temperature. Alternatively, the embodiment may be modified in such a manner as to obtain a provisional reference power magnitude corresponding to the elapsed time t and then correct the provisional reference power magnitude on the basis of values representing other factors such as ambient temperature and engine water temperature, to thereby obtain a corrected reference power magnitude Pb(t).

Next, in step S6, the main control section 111 calculates duty ratios D1(*t*) to Dn(t) for the glow plugs GP1 to GPn.

Specifically, the main control section 111 obtains the duty ratios D1(*t*) to Dn(t) from the previously obtained reference power magnitude Pb(t), applied voltages Vg1(*t*) to Vgn(t), and resistances Rg1(*t*) to Rgn(t) in accordance with equations $D1(t)=Pb(t)\cdot Rg1(t)/Vg1(t)^2$, . . . , $Dn(t)=Pb(t)\cdot Rgn(t)/Vgn(t)^2$.

Notably, the duty ratios D1(*t*) to Dn(t) may be obtained from the previously obtained reference power magnitude Pb(t), applied voltages Vg1(*t*) to Vgn(t), and the currents Ig1(*t*) to Ign(t) in accordance with equations $D1(t)=Pb(t)/(Vg1(t)\cdot Ig1(t))$, . . . , $Dn(t)=Pb(t)/(Vgn(t)\cdot Ign(t))$.

Subsequently, in step S7, the switching elements 1051 to 105*n* are turned on and off at the duty ratios D1(*t*) to Dn(t).

With this operation, even when the resistances Rg1(*t*) to Rgn(t) of the glow plugs GP1 to GPn differ from one another, electric power whose magnitude P(t) is equal to the reference power magnitude Pb(t) is supplied to each of the glow plugs GP1 to GPn. That is, at each elapsed time t after the start of electrification, electric power of the same magnitude P(t) is supplied to each of the glow plugs GP1 to GPn. Therefore, conceivably, at each point in time, the respective sheathed heaters 2 generate heats whose quantities correspond to the same energy. Therefore, under the assumption that the glow plugs GP1 to GPn are the same in terms of heat dissipation, the respective sheathed heaters 2 have substantially the same temperature, so that the temperatures of the respective sheathed heaters 2 can be raised to follow the same temperature curve.

Notably, the magnitude of electric power supplied to the glow plugs GP1 to GPn is changed to follow the curve shown in FIG. 5. Therefore, when the elapsed time t reaches the end time $t_{end}$, the respective temperatures of the glow plugs GP1 to GPn each reaches a predetermined temperature (e.g., 1300° C.).

Subsequently, in step S8, the main control section 111 determines whether or not the pre-glow period ends. Specifically, the main control section 111 determines whether or not the elapsed time t counted by the timer becomes equal to or greater than the end time $t_{end}$. When a "No" determination is made; i.e., the pre-glow period has not yet ended, the main control section 111 returns to step S2.

Meanwhile, when a "Yes" determination is made; i.e., the pre-glow period has ended, the main control section 111 ends the processing in the above-described pre-glow mode, and proceeds to the next mode.

Thus, the glow plug electrification control system 100 (the glow plug electrification control apparatus 101) of the present embodiment can cause all the glow plugs GP1 to GPn to have the predetermined raised temperature (e.g., 1300° C.) at the end time $t_{end}$.

In general, even when the plurality of glow plugs 1 are of the same part number, they have variations in characteristics, and their resistances differ from one another. Here, for the glow plug electrification control system 100, a case will be considered where the glow plug GP1 connected to the glow plug electrification control apparatus 101 is replaced with a glow plug GP1*e* having a different resistance.

The original glow plug GP1 has been described above. That is, at each elapsed time t, electric power whose magnitude P(t) is equal to the reference power magnitude Pb(t) that follows the curve shown in FIG. 5, is supplied to the glow plug GP1. Therefore, when the elapsed time t reaches the end time $t_{end}$, the temperature of the glow plug GP1 reaches the predetermined temperature (e.g., 1300° C.).

Next, the case will be considered where the glow plug GP1 is replaced with the glow plug GP1*e*. Notably, electric power is supplied, while the temperature condition (ambient temperature, water temperature of the engine (not shown)) is made the same as that in the case where the temperature of the glow plug GP1 is raised, by means of providing a sufficiently long period of time after the previous operation.

In the case of the glow plug electrification control system 100 of the present embodiment, at each elapsed time t, electric power whose magnitude P(t) is equal to the reference power magnitude Pb(t) that follows the curve shown in FIG. 5, is supplied to the glow plug GP1*e* as well. Therefore, when the elapsed time t reaches the end time $t_{end}$, the temperature of the glow plug GP1*e* also reaches the predetermined temperature (e.g., 1300° C.).

When a change in the temperature of the glow plug GP1 and a change in the temperature of the glow plug GP1*e* during the temperature rise are compared, it is found that, at each elapsed time t, electric power whose magnitude P(t) is equal to the reference power magnitude Pb(t) is supplied to both the glow plug GP1 and the glow plug GP1*e*. That is, conceivably, at each elapsed time t from the start of electrification, the same electric power is supplied to the glow plug GP1 and the glow plug GP1*e*, and, at each elapsed time t, the respective sheathed heaters 2 generate heat of the same quantity corresponding to the same energy. In addition, since the glow plug GP1 and the glow plug GP1*e* are attached to the same portion of the engine through replacement, the glow plug GP1 and the glow plug GP1*e* are substantially the same in terms of heat dissipation. Accordingly, despite that the glow plug GP1 and the glow plug GP1*e* have different resistances, the glow plug GP1 and the glow plug GP1*e* have substantially the same temperature at each elapsed time t, and their temperatures can be raised to the same temperature (e.g., 1300° C.) to follow the same temperature curve.

Notably, in the present embodiment, the switching elements 1051 to 105*n* and operations of steps S3 to S7 in the main control section 111 correspond to the temperature-raising-period electrification control means and the supply power control means. Of these steps, steps S3 to S5 correspond to the reference power magnitude provision means. Further, steps S3, S4, S6 and S7 correspond to the power magnitude control means. Of these steps, steps S3 and S4 correspond to the parameter acquisition means, step S6 corresponds to the duty ratio acquisition means, and step S7 corresponds to the pulse electrification means, respectively.

Embodiment 2

Figure 6:
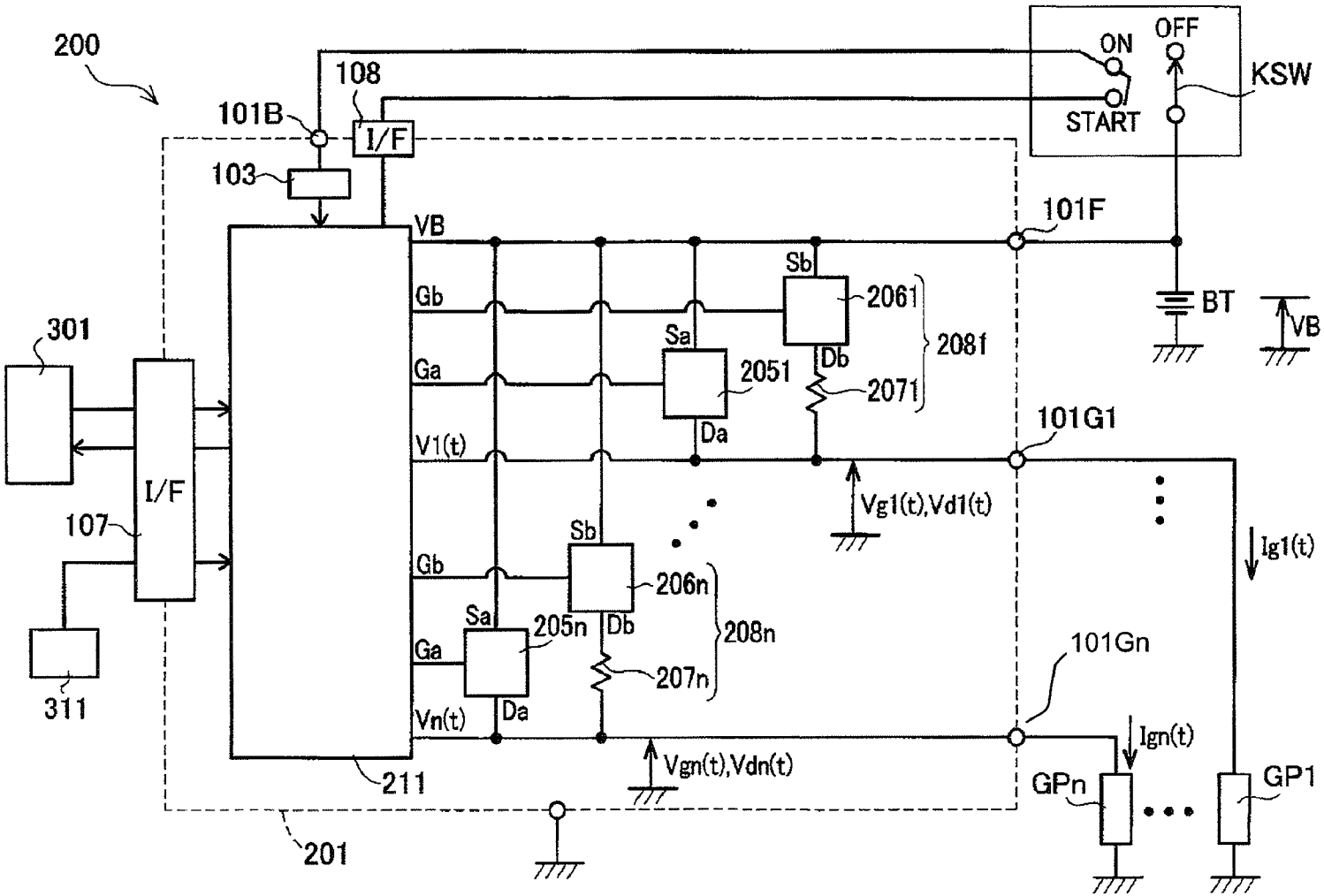
FIG. 6 is a circuit diagram showing the glow plug electrification control system and the glow plug electrification control apparatus according to Embodiment 2.

Next, a second embodiment will be described with reference to FIGS. 6 and 7. In the Embodiment 1, an FET having a current detection function is used for the switching elements 1051, etc. In contrast, in a glow plug electrification control system 200 and a glow plug electrification control apparatus 201 according to the present Embodiment 2, an FET which does not have a current detection function is used for the switching elements 2051 to 205*n* so as to start and stop supply of electric current to the glow plugs GP1 to GPn. Further, since the FET does not have a current detection function, resistance division circuits 2081 to 208*n* are separately provided so as to detect the resistances Rg1(*t*), etc. of the glow plugs GP1, etc. Further, a step is provided in the processing flow so as to detect the resistances Rg1(*t*), etc. of the glow plugs GP1, etc. by use of the resistance division circuits 2081, etc. These different portions will be mainly described, and other similar portions will not be described or will be described briefly.

Since the glow plugs GP1, etc. used in the present Embodiment 2 are identical with those used in Embodiment 1, their description will not repeated.

Next, the glow plug electrification control system 200 and the glow plug electrification control apparatus 201 of the present Embodiment 2 will be described. FIG. 6 is a block diagram showing the electrical configuration of the glow plug electrification control system 200 and the glow plug electrification control apparatus 201 of the present Embodiment 2. The glow plug electrification control system 200 includes not only the glow plug electrification control apparatus 201 but also glow plugs GP1 to GPn, a battery BT, and a key switch KSW, which are similar to those employed in Embodiment 1. Further, the glow plug electrification control system 200 is connected to an ECU 301 and an alternator 311 via an interface circuit 107.

A main control section 211 of the glow plug electrification control apparatus 201 receives via a power supply circuit 103 a stable operation voltage for signal processing. When the key switch KSW is turned to the ON position or the start position, the main control section 211 operates. Meanwhile, when the key switch KSW is turned to the OFF position, the main control section 211 stops the operation. Notably, as in the case of the Embodiment 1, when the key switch KSW is turned to the start position, a signal indicating that the key switch KSW has been turned to the start position is fed to the main control section 211 via the interface circuit 108, whereby the main control section 211 can detect the engine cranking.

Further, electric power is supplied from the battery BT to n switching elements 2051 to 205*n* via a battery connection terminal 101F. In the present Embodiment 2, unlike Embodiment 1, an ordinary MOSFET which does not have a current detection function is used for the switching elements 2051 to 205*n*. The voltage VB of the battery BT is supplied to respective source terminals Sa of the switching elements 2051 to 205*n*. Meanwhile, respective drain terminals Da of the elements 2051 to 205*n* are connected to a plurality of (n) glow plugs GP1 to GPn via corresponding glow connection terminals 101G1 to 101Gn, as in the case of Embodiment 1. Switching signals are supplied from the main control section 211 to respective gate terminals Ga of the elements 2051 to 205*n*. The elements 2051 to 205*n* turn ON and OFF in accordance with the voltage levels (high/low) of the switching signals so as to switch (ON/OFF) the supply of electricity to the glow plugs GP1 to GPn.

Further, as in the case of Embodiment 1, voltage signals V1(*t*) to Vn(t) are supplied to the main control section 211. The voltage signals V1(*t*) to Vn(t) represent voltages Vg1(*t*) to Vgn(t) applied to the glow plugs GP1 to GPn at timings when the switching elements 2051 to 205*n* are on.

Moreover, the glow plug electrification control apparatus 201 includes resistance division circuits 2081 to 208*n* in parallel with the switching elements 2051 to 205*n*. The resistance division circuits 2081 to 208*n* are composed of FETs 2061 to 206*n*, which are supplementary switching elements, and reference resistors 2071 to 207*n* (resistance Rref=1.0Ω) connected in series with the FETs.

The resistance division circuits 2081 to 208*n* are used as follows. That is, the FETs 2061 to 206*n* are usually off. However, these FETs 2061 to 206*n* (with source terminals Sb and drain terminals Db) are turned on by means of signals from corresponding gate terminals Gb at timings when the corresponding switching elements 2051 to 205*n* are off. As a result, a voltage is applied to the glow plugs GP1 to GPn via the corresponding FETs 2061 to 206*n* and the corresponding reference resistors 2071 to 207*n*. At that time, divided voltages Vd1(*t*) to Vdn(t) are generated across the glow plugs GP1 to GPn, respectively. The divided voltages Vd1(*t*) to Vdn(t) assume respective values obtained by dividing (resistance division) the battery voltage VB (accurately, a voltage obtained by subtracting an ON voltage of the FETs 2061, etc. from the battery voltage VB) by the reference resistors 2071 to 207*n* and the glow plugs GP1 to GPn.

Since the resistance Ref of the reference resistors 2071 to 207*n* is known (e.g., Rref=1.0Ω), by means of separately inputting the battery voltage VB to the main control section 211, the resistances Rg1(*t*) to Rgn(t) of the glow plugs GP1 to GPn can be detected.

In this manner, the resistances Rg1(*t*) to Rgn(t) of the glow plugs GP1 to GPn can be detected without use of relatively expensive FETs which are used in Embodiment 1 and have a current detection function.

Figure 7:
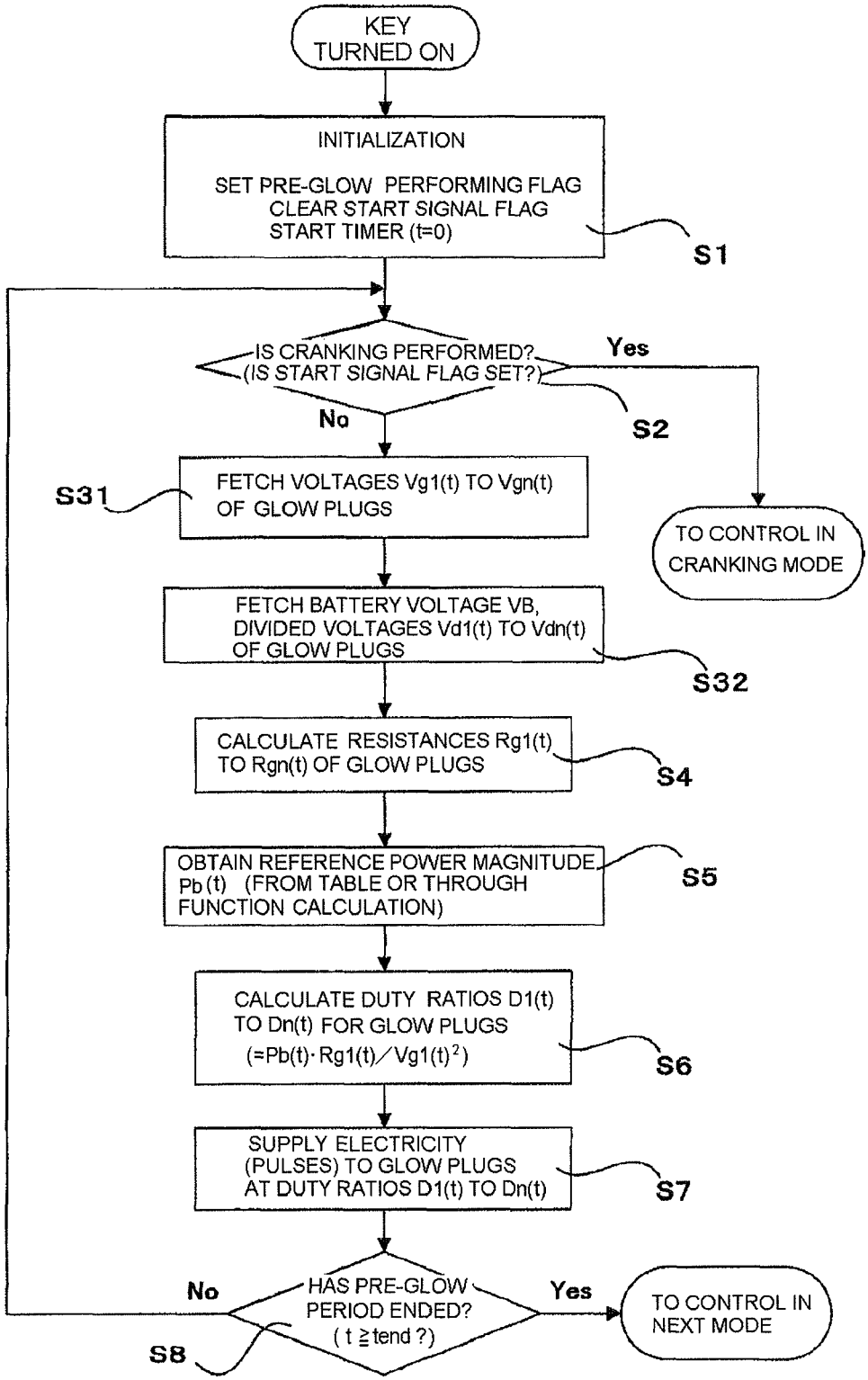
FIG. 7 is a flow chart showing electrification control performed by the glow plug electrification control apparatus according to Embodiment 2.

Specifically, as shown in FIG. 7, after determining in step S2 whether or not engine cranking is performed, the main control section 211 performs step S31 in place of step S3 in Embodiment 1. In step S31, the main control section 211 fetches, as voltage signals V1(*t*) to Vn(t), voltages Vg1(*t*) to Vgn(t) applied to the glow plugs GP1 to GPn at timings when the switching elements 2051 to 205*n* are on (the FETs 2061 to 206*n* are off).

in step S32, the main control section 211 fetches divided voltages Vd1(*t*) to Vdn(t) applied to the glow plugs GP1 to GPn at timings when the switching elements 2051 to 205*n* are off and the FETs 2061 to 206*n* are on. Also, the main control section 211 fetches the battery voltage VB.

Subsequently, as in the case of Embodiment 1, in step S4, the main control section 111 calculates the resistances Rg1(*t*) to Rgn(t) of the glow plugs GP1, etc., at the instant time (at the elapsed time t from the start of electrification). However, unlike Embodiment 1, the respective resistances are obtained by use of equations Rg1(*t*)=Rref·Vd1(*t*)/(VB−Vd1(*t*)), . . . , Rref·Vdn(t)/(VB−Vdn(t)).

Since the remaining steps are identical with those in Embodiment 1, their description will not be repeated.

Thus, in the glow plug electrification control system 200 and the glow plug electrification control apparatus 201 of the present Embodiment 2 as well, the temperatures of all the glow plugs GP1 to GPn can be increased to the predetermined temperature (e.g., 1300° C.) at the end time $t_{end}$.

Further, even when the glow plug GP1 is replaced with the glow plug GP1*e*, as in the case of Embodiment 1, the temperature of the glow plug GP1*e* reaches the predetermined temperature (e.g., 1300° C.) when the elapsed time t reaches the end time $t_{end}$.

Moreover, when a change in the temperature of the glow plug GP1 and a change in the temperature of the glow plug GP1*e* during the temperature rise are compared, it is found that, despite having different resistances, the glow plug GP1 and the glow plug GP1*e* have substantially the same temperature at each elapsed time t, and their temperatures can be raised to the same temperature (e.g., 1300° C.) to follow the same temperature curve.

Notably, in the present Embodiment 2, the switching elements 2051 to 205*n* and operations of steps S31 and S32 to S7 in the main control section 211 correspond to the temperature-raising-period electrification control means and the supply power control means. Of these steps, steps S31 and S32 to S5 correspond to the reference power magnitude provision means. Further, step S31, S32, S4, S6 and S7 correspond to the power magnitude control means. Of these steps, steps S31, S32 and S4 correspond to the parameter acquisition means.

Modification 1

Figure 8:
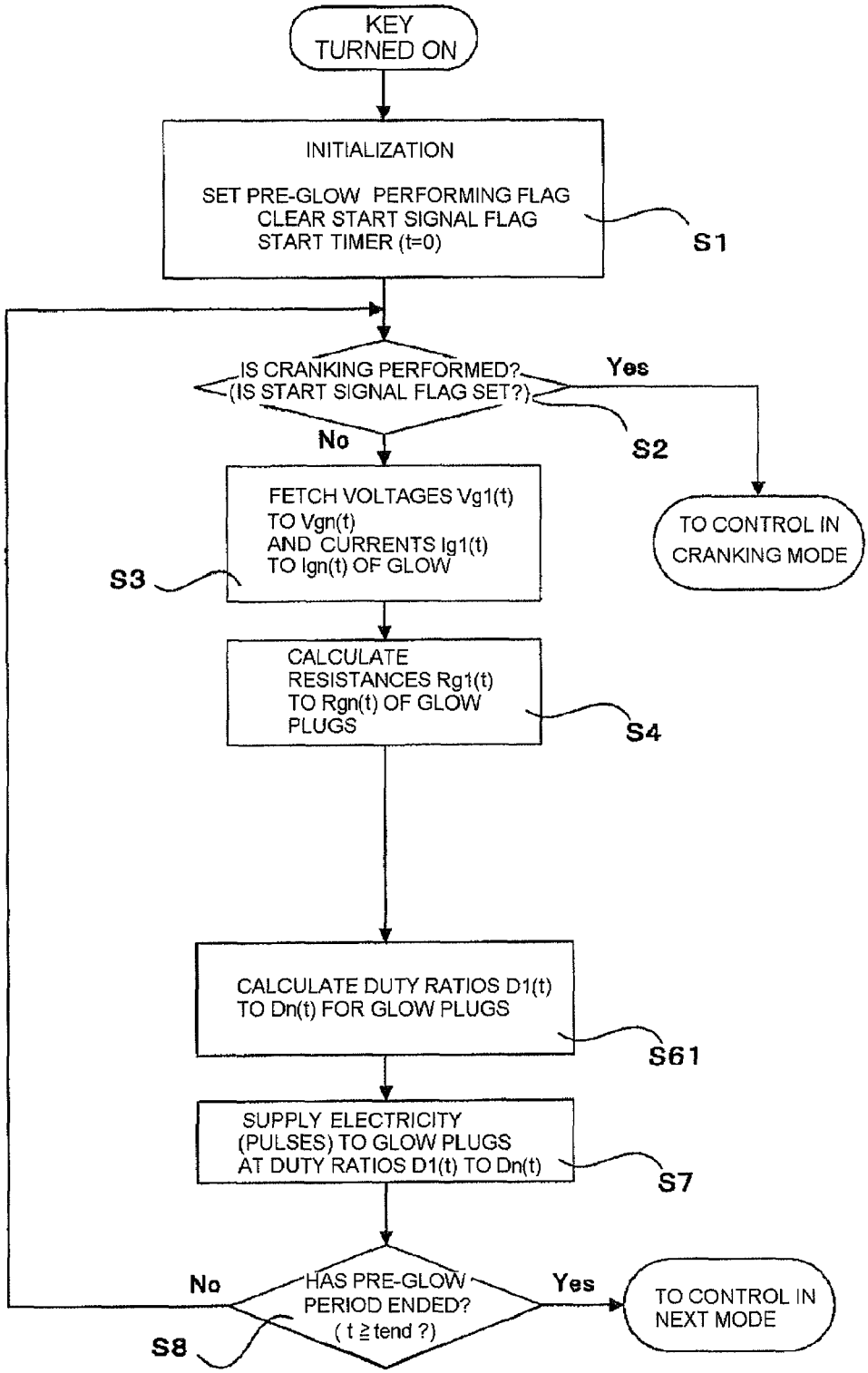
FIG. 8 is a flow chart showing electrification control performed by the glow plug electrification control apparatus according to Modification 1.

For example, in Embodiments 1 and 2, in addition to the applied voltages Vg1(*t*), etc., the currents Ig1(*t*), etc., or the resistances Rg1(*t*), etc., the reference power magnitude Pb(t) acquired in step S5 is used so as to obtain the duty ratios D1(*t*), etc. The present Modification 1 differs from Embodiment 1 only in the method of obtaining the duty ratios D1(*t*) to Dn(t). Only this difference will be described with reference to FIG. 8.

As described above, the reference power magnitude Pb(t) used in Embodiments 1 and 2 can be unequivocally obtained from the elapsed time t, calculated in consideration of engine water temperature or the like as well as the elapsed time t, or obtained from a table previously prepared through calculation. Accordingly, the duty ratios D1(*t*) to Dn(t) can be obtained without obtaining the reference power magnitude Pb(t).

That is, in the present Modification 1, without obtaining the reference power magnitude Pb(t) in step S5, the duty ratios D1(*t*), etc., are obtained. That is, step S5 in Embodiments 1 and 2 is eliminated, and step S61, which corresponds to step S6, is provided so as to obtain the duty ratios D1(*t*), etc., from the elapsed time t and the applied voltages Vg1(*t*), etc., the currents Ig1(*t*), etc., or the resistances Rg1(*t*), etc., through calculation or by making use of a previously prepared table.

In the present Modification 1, the switching elements 1051 to 105*n* and operations of steps S3, S4, S61 and S7 in the main control section 111 correspond to the temperature-raising-period electrification control means and the supply power control means. Of these steps, steps S3 and S4 correspond to the parameter acquisition means, step S61 corresponds to the duty ratio acquisition means, and step S7 corresponds to the pulse electrification means.

The present invention has been described with reference to Embodiments 1 and 2, and Modification 1. However, needless to say, the present invention is not limited to Embodiments 1 and 2, etc., and can be appropriately modified for application without departing from the scope of the invention.

For example, in Embodiment 1 and Modification 1, in step S4, the resistances Rg1(*t*) to Rgn(t) of the glow plugs are obtained from the applied voltages Vg1(*t*), etc. and the currents Ig1(*t*), etc.

However, the duty ratios D1(*t*) to Dn(t) can be obtained without use of the step for obtaining the resistances Rg1(*t*), etc. That is, the duty ratios D1(*t*), etc., may be calculated by use of the applied voltages Vg1(*t*), etc. and the currents Ig1(*t*), etc.

Further, in Embodiment 1, etc., when the key switch KSW is turned on, the glow plug electrification control system 100 (the glow plug electrification control apparatus 101) starts and supply of electric current to the glow plugs GP1, etc., is started. However, Embodiment 1, etc., may be modified such that supply of electric current to the glow plugs GP1, etc., is started when an instruction is issued from the engine control unit 301 via the interface circuit 107 after the operator turns the key switch KSW on and the glow plug electrification control apparatus 101 starts up.

It should further be apparent to those skilled in the art that various changes in form and detail of the invention as shown and described above may be made. It is intended that such changes be included within the spirit and scope of the claims appended hereto.

This application is based on Japanese Patent Application No. JP 2008-142451 filed May 30, 2008, incorporated herein by reference in its entirety.

What is claimed is:

1. A glow plug electrification control apparatus which supplies electric current to a heater section of a glow plug to thereby generate heat and raise the temperature of the heater section, the electrification control apparatus comprising:

temperature-raising-period electrification control means for raising the temperature of the heater section of the glow plug during a predetermined length of time in such manner that, when a first glow plug and a second glow plug, which differ in resistance, are selectively connected to the electrification control apparatus and electrification control is performed therefor, at sampled timings during the temperature rise, electric power of the same magnitude as that of electric power supplied to the first glow plug is supplied to the second glow plug.

2. The glow plug electrification control apparatus according to claim 1, wherein the temperature of the heater section of each of the first glow plug and the second glow plug is raised under the same ambient temperature conditions.

3. The glow plug electrification control apparatus according to claim 1, wherein the temperature-raising-period electrification control means includes supply power magnitude control means for supplying the glow plug with electric power of a magnitude which is previously determined in accordance with time which has elapsed from the start of supply of electric current to the heater section.

4. The glow plug electrification control apparatus according to claim 3, wherein the supply power control means includes:

reference power magnitude provision means for providing a reference power magnitude Pb(t) to be supplied to the glow plug at an elapsed time t, as counted from the start of supply of electric current to the heater section; and power magnitude control means for performing electrification control such that the magnitude of electric power supplied to the glow plug at the elapsed time t coincides with the reference power magnitude Pb(t).

5. The glow plug electrification control apparatus according to claim 4, wherein the power magnitude control means includes:

parameter acquisition means for acquiring, at each elapsed time t, a voltage Vg(t) applied to the glow plug and at least one of a current Ig(t) flowing through the glow plug and a resistance Rg(t) of the glow plug;

duty ratio acquisition means for acquiring a duty ratio D(t) by use of the reference power magnitude Pb(t), the applied voltage Vg(t), and at least one of the current Ig(t) and the resistance Rg(t); and pulse electrification means for supplying the glow plug with electricity in the form of pulses and at the duty ratio D(t).

6. The glow plug electrification control apparatus according to claim 3, wherein the supply power control means includes:

parameter acquisition means for acquiring, at each elapsed time t, a voltage Vg(t) applied to the glow plug and at least one of a current Ig(t) flowing through the glow plug and a resistance Rg(t) of the glow plug;

duty ratio acquisition means for acquiring a duty ratio D(t) by use of the resistance Rg(t) and the applied voltage Vg(t); and pulse electrification means for supplying the glow plug with electric current in the form of pulses and at the duty ratio D(t).

7. A glow plug electrification control system comprising a glow plug electrification control apparatus according to claim 1, and a glow plug.

8. The glow plug electrification control apparatus according to claim 1, wherein the first glow plug and the second glow plug are of the same industrial part number but differ in resistance due to a characteristic variation therebetween.

* * * * *